US011592012B2

(12) United States Patent
Breuer et al.

(10) Patent No.: US 11,592,012 B2
(45) Date of Patent: Feb. 28, 2023

(54) HYDROSTATIC PISTON MACHINE UNIT

(71) Applicant: Robert Bosch GmbH, Stuttgart (DE)

(72) Inventors: David Breuer, Tuebingen (DE); Peter Roos, Horb (DE); Rudolf Appel, Horb (DE); Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 156 days.

(21) Appl. No.: 16/998,121

(22) Filed: Aug. 20, 2020

(65) Prior Publication Data

US 2021/0071528 A1 Mar. 11, 2021

(30) Foreign Application Priority Data

Sep. 10, 2019 (DE) ..... 10 2019 213 675.3

(51) Int. Cl.

| | |
|---|---|
| ***F04B 1/24*** | (2006.01) |
| ***F04B 1/2014*** | (2020.01) |
| ***F01B 3/00*** | (2006.01) |
| ***F04B 1/128*** | (2020.01) |
| ***F04B 11/00*** | (2006.01) |
| *F03C 1/06* | (2006.01) |

(52) U.S. Cl.

CPC ..... *F04B 1/2014* (2013.01); *F01B 3/0038* (2013.01); *F01B 3/0094* (2013.01); *F04B 1/128* (2013.01); *F04B 1/24* (2013.01); *F04B 11/00* (2013.01); *F03C 1/0642* (2013.01)

(58) Field of Classification Search

CPC ..... F04B 1/22–24; F04B 23/06; F04B 53/001–004; F04B 53/16; F04B 2201/0804; F04B 11/00–0033; F01B 3/0035–0038; F01B 21/02; F03C 1/0639; F03C 1/0642

See application file for complete search history.

(56) References Cited

U.S. PATENT DOCUMENTS

| | | | | |
|---|---|---|---|---|
| 925,148 | A * | 6/1909 | Williams | F16H 61/423 188/294 |
| 3,596,568 | A * | 8/1971 | Wittren | F01B 3/0032 91/472 |
| 4,534,271 | A * | 8/1985 | Forster | F04B 1/22 91/472 |
| 10,018,174 | B2 * | 7/2018 | Iida | F04B 1/2035 |
| 2009/0290997 | A1 * | 11/2009 | Mehta | F04B 1/22 91/499 |

(Continued)

FOREIGN PATENT DOCUMENTS

| | | | | |
|---|---|---|---|---|
| DE | 30 41 832 | A1 | 5/1982 | |
| DE | 3041832 | A1 * | 5/1982 | F04B 1/22 |

(Continued)

*Primary Examiner* — Kenneth J Hansen
*Assistant Examiner* — Thomas Fink
(74) *Attorney, Agent, or Firm* — Maginot, Moore & Beck LLP

(57) ABSTRACT

A hydrostatic piston machine unit, which is in particular designed as a hydrostatic axial piston machine unit, comprises at least two driving mechanisms that can be driven synchronously and have displacement pistons which each perform a reciprocating motion in operation and are provided for delivery into a common pressure line. The hydrostatic piston machine unit has a jointly assigned precompression volume for the at least two driving mechanisms.

13 Claims, 2 Drawing Sheets

(56) References Cited

U.S. PATENT DOCUMENTS

2013/0298754 A1* 11/2013 Krebs ..... F04B 1/2042
91/418

FOREIGN PATENT DOCUMENTS

| | | | |
|---|---|---|---|
| DE | 37 00 573 | A1 | 7/1988 |
| DE | 42 29 544 | A1 | 3/1993 |
| DE | 42 29 544 | C2 | 3/1993 |
| DE | 10 2012 218 883 | A1 | 5/2013 |

* cited by examiner

HYDROSTATIC PISTON MACHINE UNIT

This application claims priority under 35 U.S.C. § 119 to application no. DE 10 2019 213 675.3, filed on Sep. 10, 2019 in Germany, the disclosure of which is incorporated herein by reference in its entirety.

The disclosure relates to a hydrostatic piston machine unit, which, in particular, is designed as a hydrostatic axial piston machine unit and comprises two driving mechanisms that can be driven synchronously and have displacement pistons which each perform a reciprocating motion in operation and are provided for delivery into a common pressure line. A hydrostatic piston machine unit of this kind having a plurality of driving mechanisms is also referred to as a hydrostatic multiple unit (multiple pump or multiple motor). If there are precisely two driving mechanisms, the term used is "double pump" or "double motor".

BACKGROUND

A double pump of the type designated above is known from DE 30 41 832 A1. This double pump has two driving mechanisms of swash plate design, and is of integrated construction inasmuch as there is a pot-shaped housing part accommodating a driving mechanism arranged on each side of a central part, common to both component pumps, on which there are a pressure connection and a suction connection.

DE 37 00 573 A1 has disclosed a hydrostatic radial piston machine, and DE 10 2012 218 883 A1 or DE 42 29 544 A1 have disclosed a hydrostatic axial piston machine of swash plate design and having precisley one driving mechanism, said machines having a fluid volume acting as a precompression volume (PCV) for a changeover region, in which the displacement pistons reverse their direction of motion. The term "fluid volume" is taken to mean a cavity which is filled or is to be filled with a liquid pressure medium, e.g. hydraulic oil, and in which a change in pressure is associated with an inflow or outflow of pressure medium, if only because of the compressibility of the pressure medium. It is also possible to assign each of the two changeover regions a dedicated precompression volume. By means of precompression volumes of this kind, it is possible to keep the pulsation of the volume flow low and thus to keep down the noise level of a hydrostatic piston machine.

In the case of the known axial piston machines, the displacement pistons are located in cylinder bores of a cylinder barrel and delimit therein a displacement space which can be connected alternately, via a connecting opening introduced into the end of the cylinder barrel, to a kidney-shaped low-pressure control port and a kidney-shaped high-pressure control port, each introduced into a control plate acting as a control part. In operation, the end of the cylinder barrel slides along the control plate. The low-pressure control port and the high-pressure control port lie on a common pitch circle and are spaced apart from one another in the circumferential direction, thereby forming two changeover regions. In one changeover region, each displacement piston is in the region of its inner dead center position or bottom dead center (BDC), in which it is plunged furthest into its cylinder bore, and, in the other changeover region, it is in the region of its outer dead center position or top dead center (TDC), in which it projects furthest out of its cylinder bore. In the case of an axial piston machine shown in FIG. 1 of DE 42 29 544 C2, an outlet of a connecting line connected to the PCV opens into the changeover region in which a respective displacement piston is in the region of its BDC. The PCV, in turn, is connected to the high-pressure control port via a slide valve and a restrictor, thereby enabling the PCV to be supplied with high pressure and to be charged slowly via the restrictor when the slide valve is open. When viewed in the radial direction, the outlet in the changeover region lies outside the maximum diameter of the low-pressure control port and of the high-pressure control port. The connecting opening of a respective displacement space bounded by the cylinder bore and the displacement piston has an opening portion, which likewise lies outside the maximum diameter of the low-pressure control port and of the high-pressure control port in order to make it possible for the connecting opening to overlap with the outlet.

When there is a movement of the cylinder barrel relative to the control plate, the connecting opening of a respective displacement space slides over the changeover region having the outlet, as a result of which the displacement space is connected to the PCV via the connecting line during a certain contact time, and the pressure in the displacement space rises and the pressure in the PCV falls until the pressure in the displacement space and in the PCV is the same. After the separation from the displacement space, the pressure in the PCV rises to the high pressure again owing to the inflow of pressure medium from the high-pressure side through the restricted and valve-controlled connection. Such pre-filling of the displacement space is intended to reduce the pressure pulsations on the high-pressure side.

In the case of another hydrostatic axial piston machine known from DE 42 29 544 C2, the outlet of a connecting passage to the PCV is close to the high-pressure control port. The connecting openings have a contour such that the outlet is increasingly exposed by a connecting opening as soon as the connecting opening has left the low-pressure control port, and pressure fluid is released quickly under high pressure from the PCV into the displacement space. The outlet of the passage is then briefly closed again. The outlet is then increasingly exposed again in order to bring the PCV back to a high pressure through the inflow of pressure medium from the high-pressure control port via the connecting opening.

In the case of the radial piston machine according to DE 37 00 573, the connection of the PCV to an outlet in one changeover region and to the high-pressure side corresponds to the connection of the PCV in the axial piston machine from DE 42 29 544 A1, which was first described above, with the difference that there is no slide valve in the connection to the high-pressure side.

In the case of the axial piston machine according to DE 10 2012 218 883 A1, as in the second axial piston machine known from DE 42 29 544 A1, there is no line between the PCV and the high-pressure side, apart from the connecting line leading directly from the changeover region to the PCV.

SUMMARY

It is the underlying object of the disclosure to develop a hydrostatic piston machine unit, which, in particular, is designed as a hydrostatic axial piston machine unit and comprises at least two driving mechanisms that can be driven synchronously and have displacement pistons which each perform a reciprocating motion in operation and are provided for delivery into a common pressure line or into a common pressure connection, in such a way that low pulsation of the volume flow and thus a low noise level are obtained with low costs and without an excessive increase in the installation space.

This is achieved by virtue of the fact that the driving mechanisms are jointly assigned a precompression volume. In the case of a hydrostatic piston machine according to the disclosure, the two changeover systems—which are of the same kind—of the two driving mechanisms primarily at least the changeover system from low pressure to high pressure, are assigned just a single precompression volume, from which a pressure fluid effecting a pressure rise flows to the displacement spaces both of one driving mechanism and to the displacement spaces of the other driving mechanism, even before a displacement space opens toward the high-pressure control port of a control part. In comparison, significantly more installation space would be required if a dedicated precompression volume were provided for each driving mechanism, i.e. two precompression volumes for two driving mechanisms.

A hydrostatic piston machine according to the disclosure can be refined in an advantageous manner.

The disclosure can be implemented, in particular, on a hydrostatic piston machine unit in which first displacement pistons performing a reciprocating motion in operation are arranged in a first rotating cylinder part having a plurality of first cylinder spaces, wherein each first cylinder space can be connected alternately via a connecting opening to a low-pressure control port and a high-pressure control port of a stationary control part, on which there are, between the low-pressure control port and the high-pressure control port, two changeover regions, within which the first displacement pistons reverse their direction of motion at a dead center position, and in which second displacement pistons performing a reciprocating motion in operation are arranged in a second rotating cylinder part having a plurality of second cylinder spaces, wherein each second cylinder space can be connected alternately via a connecting opening to a low-pressure control port and a high-pressure control port of a stationary control part, on which there are, between the low-pressure control port and the high-pressure control port, two changeover regions, within which the second displacement pistons reverse their direction of motion at a dead center position, wherein the cylinder spaces are connected fluidically in the region of a changeover region to the precompression volume via a connecting line. The low-pressure control port and the high-pressure control port for the first driving mechanism and the low-pressure control port and the high-pressure control port for the second driving mechanism can be located on the same component, as is the case in the axial piston unit according to DE 30 41 832 A1. The control part then usually also forms part of the housing. However, the control part in the axial piston units that are currently in use is usually a separate control plate, which is held nonrotatably on a housing part. Where there are two driving mechanisms, therefore, there are then also two control plates.

A first precompression volume for changing over from the low-pressure control port to the high-pressure control port and a second precompression volume for the changeover from the high-pressure control port to the low-pressure control port can be provided.

It is preferred if each connecting opening can be connected in a changeover region to the precompression volume via the outlet, situated in the changeover region, of a connecting line, at the earliest when the connection to one control port is still restricted and before there is an overlap with the other control port. If there is still a restricted connection to one control port, the changeover is gentler than in the case of an overlap of the outlet only after complete separation from the one control port. The gentler changeover has advantages in terms of noise engineering. There is then an angular range in which a connecting opening is connected neither to the high-pressure control port nor to the low-pressure control port but only to the precompression volume. In this angular range, only the volume of the cylinder space and the precompression volume together with the design of the connecting line determine how the pressure changes in the cylinder space.

It is advantageous if, within a certain angular range, a connecting opening is open simultaneously to the precompression volume and to the control opening to which a changeover is being made, and wherein, to match the pressure in the precompression volume to the pressure in the control port to which a changeover is being made, pressure fluid flows between this control port and the precompression volume via the connecting opening and via the connecting line. In the case of a changeover from the low-pressure control port to the high-pressure control port, therefore, a cylinder space is initially connected fluidically only to the precompression volume. Thus, owing to an inflow of pressure fluid from the precompression volume to the cylinder space, the pressure in the cylinder space rises, while it falls in the precompression volume, until a pressure equalization has taken place. When the connecting opening is then also open toward the high-pressure control port, pressure fluid flows out of said port back to the precompression volume, with the result that the pressure increases to high pressure again in said volume.

The precompression volume can additionally be connected permanently in a restricted manner to the high-pressure side of the piston unit via a second connecting line.

If the hydrostatic piston machine unit is an axial piston machine unit of swash plate design, then, as known per se from DE 30 41 832 A1, the first cylinder part and the second cylinder part are advantageously arranged in alignment with one another. The two cylinder parts can advantageously be driven via a common shaft, wherein it is also possible for the shaft to be made up of a plurality of shaft sections connected to one another in a manner which prevents relative rotation.

The two driving mechanisms preferably have the same number of displacement pistons and are rotated relative to one another by a half piston pitch in such a way that the displacement pistons of one driving mechanism in each case reverse their direction of motion in the center of the angular interval between two displacement pistons of the other driving mechanism. The behavior of the two driving mechanisms in respect of the characteristic of the instantaneous volume flow then corresponds to the behavior of a driving mechanism with twice the number, i.e. an even number, of displacement pistons as one of the two driving mechanisms. In order to obtain the angular offset between the displacement pistons, one cylinder part can be arranged on the shaft in a manner offset by a half piston pitch relative to the other cylinder part. However, it is also possible for the swash plate and the control part to be jointly rotated relative to the other swash plate and the other control part.

In the case of an angular offset of the two driving mechanisms relative to one another in such a way that the displacement pistons of one driving mechanism each reverse their direction of motion at an angular offset relative to the displacement pistons of the other driving mechanism, it is possible alternately for either only a first cylinder space or only a second cylinder space to be connected directly to the precompression volume assigned to a changeover region. As a result, the precompression volume only ever interacts with one cylinder space and therefore its size need also only be matched to one cylinder space. The precompression volume can then be significantly smaller than in a case in which it is connected simultaneously to two cylinder spaces because there is no offset between the displacement pistons of the two driving mechanisms.

The hydrostatic piston machine unit can comprise two complete separate hydraulic units, which are preferably flanged to one another and each of which has two work connections, which are connected externally to one another.

As a particular preference, however, the hydrostatic piston machine unit has two work connections, which are common to the two driving mechanisms, e.g. one work connection which serves as a high-pressure connection and one work connection which serves as a low-pressure or suction connection, and are formed on a common housing accommodating the two driving mechanisms.

BRIEF DESCRIPTION OF THE DRAWINGS

An illustrative embodiment of a hydrostatic piston machine according to the disclosure which is designed as a variable-displacement double axial piston pump of swash plate design is illustrated in simplified form in the drawings. The disclosure is now explained in greater detail with reference to the figures of these drawings, in which.

DETAILED DESCRIPTION

Figure 1:
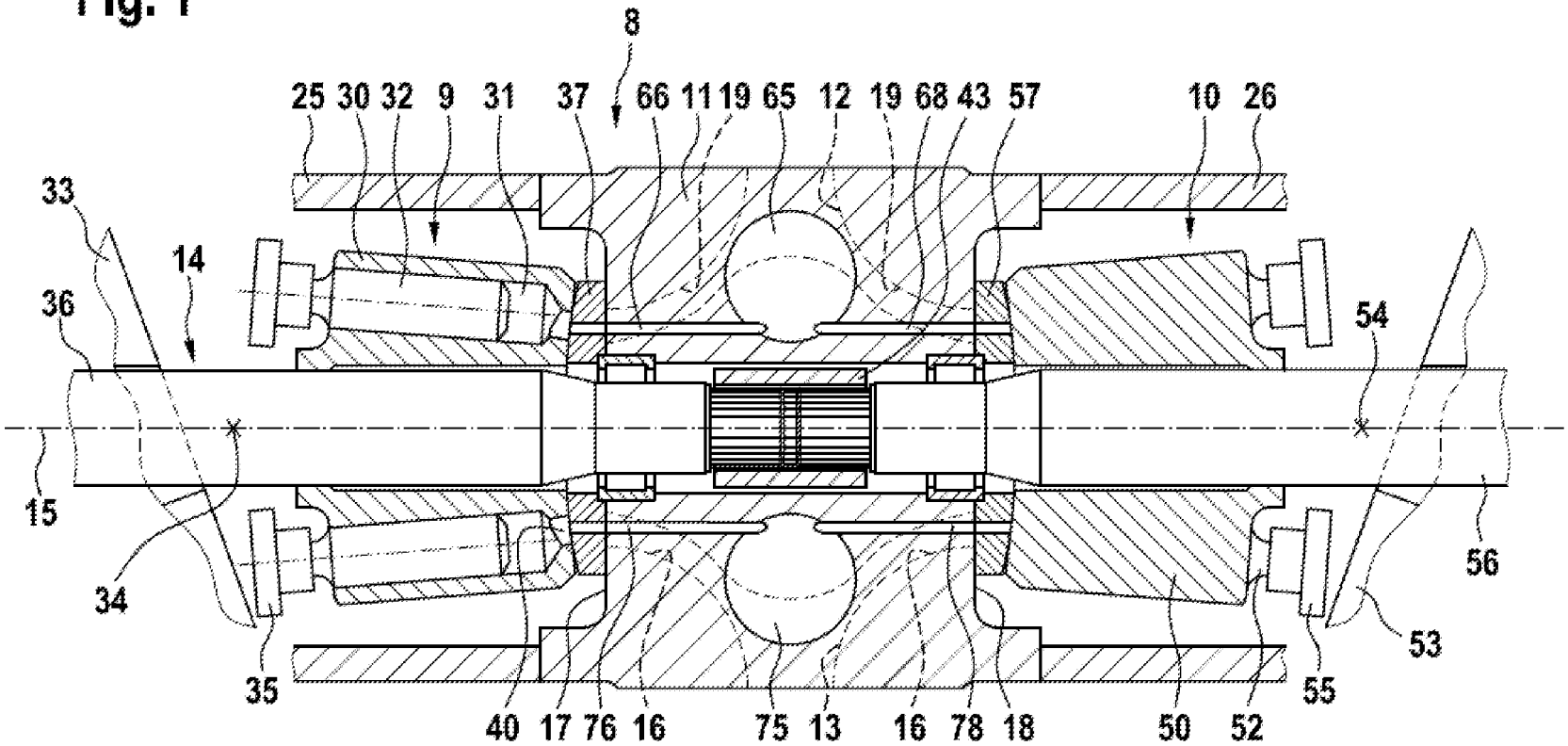
FIG. 1 shows a longitudinal section through the illustrative embodiment perpendicularly to the pivoting axes of the swash plates.

The hydrostatic axial piston machine according to the figures is provided as a variable-displacement axial piston pump for the purpose of supplying pressure medium to one or more hydraulic loads, e.g. hydraulic cylinders, in an open hydraulic circuit. It is embodied as a swash plate design. An open hydraulic circuit means that the axial piston pump receives pressure medium via a low-pressure or suction connection and discharges it to the hydraulic loads via a high-pressure connection and that the pressure medium flowing away from the hydraulic loads flows back into a tank. The volume flow of the axial piston pump is proportional to the drive speed and to the displacement, which is the quantity of pressure medium delivered in each revolution.

The hydrostatic axial piston pump shown is a "double pump", in which a first driving mechanism 9 and a second driving mechanism 10 are accommodated in a common multipart housing 8. The housing 8 has a central housing part 11, on which a high-pressure connection 12 and a low-pressure connection 13 are formed as work connections on opposite side walls and which has a central passage for a drive shaft 14 with an axis of rotation 15. Extending out from the low-pressure connection 13 in the central housing part 11 are two low-pressure passages 16, of which one emerges at a first end wall 17 perpendicular to the axis of rotation 15 and one emerges at a second end wall 18 of the central housing part 11, said second end wall being situated opposite the first end wall and likewise being perpendicular to the axis of rotation 15. Extending out from the high-pressure connection 12 in the central housing part 11 are two high-pressure passages 19, of which one emerges at the first end wall 17 and one emerges at the second end wall 18 of the central housing part 11. The outlets of the passages 16 and 19 in the end walls 17 and 18 are curved in the form of circular arcs and, for example, extend over an angle of approximately 120 degrees. The side walls having the work connections 12 and 13, and the passages 16 and 19, extend outside the section plane of FIG. 1 and are therefore indicated only by dashed lines.

A first pot-shaped housing part 25 is flanged to the central housing part 11 on one side, that facing in the direction of the axis of rotation 15, and a second pot-shaped housing part 26 is flanged to the central housing part 11 on the opposite side. The first driving mechanism 9 is accommodated by the first pot-shaped housing part 25, and the second driving mechanism 10 is accommodated by the second pot-shaped housing part 26.

Driving mechanism 9 comprises a cylinder barrel 30, in which circular-cylindrical cylinder spaces 31 which extend at a slight slope to the axis of rotation 15 and are open on that side of the cylinder barrel which faces away from the central housing part 11, are uniformly distributed and lie on the same pitch circle. In the text which follows, the cylinder spaces are referred to as cylinder bores because of their circular-cylindrical cross section, even if they are not or not exclusively produced by boring from solid material. A displacement piston 32 is guided in a longitudinally movable manner in each cylinder bore 31. In housing part 25, a swash plate 33 is mounted so as to be pivotable about a pivoting axis 34 perpendicularly intersecting the axis of rotation 15. In operation, the displacement pistons 32 are supported on the swash plate 33 via piston shoes 35 held on the pistons. The cylinder barrel 30 is coupled to a component shaft 36, passing through it, of the drive shaft 14 in a manner secure against relative rotation but allowing axial movement, and in operation is rotated about the axis of rotation 15 by means of the drive shaft 14.

In the axial direction, the cylinder barrel 30 is supported on a control plate 37, which forms a control part and is held nonrotatably on the end wall 17 of the central housing part 11. The control plate 37 has two arc-shaped control slots 38 and 39 passing through it, wherein the low-pressure control slot 38 is open toward the outlet of one low-pressure passage 16 extending in the central housing part 11, and the high-pressure control slot 39 is open toward the outlet of one high-pressure passage 19 extending in the central housing part 11. Thus, the low-pressure control slot 38 is the low-pressure control port, and the high-pressure control slot 39 is the high-pressure control port. The high-pressure control slot 39 exposed to the high pressure in operation is divided by narrow webs into a plurality of partial slots to ensure that the control plate 37 has a high strength in the region of the control slot 39.

An elongate connecting opening 40 provides a fluidic connection from each cylinder bore 31 to that end of the cylinder barrel 30 which faces the control plate 37. Said barrel rests by means of the end having the connecting openings 40 against the control plate 37 and, in operation, slides across the control plate. The two control slots 38 and 39 of the control plate 37 are situated on the same pitch circle as the connecting openings 40. In operation, there is a high pressure (e.g. a pressure of 200 bar) in the high-pressure control slot 39, while, in operation, there is a low pressure (e.g. a pressure of less than 5 bar), in particular tank pressure, in the low-pressure control slot 38. Between the high-pressure control slot 39 and the low-pressure control slot 38 there are two changeover regions on the control plate, namely a changeover region 41, in which the connecting openings 40 change over from an open fluidic connection to the low-pressure control slot 38 to an open fluidic connection to the high-pressure control slot 39, and a changeover region 42, in which the connecting openings 40 change over from an open fluidic connection to the high-pressure control slot 39 to an open fluidic connection to the low-pressure control slot 38.

It is also within the two changeover regions that the dead center positions in the stroke motion of the pistons are located, at which the pistons are plunged furthest into a cylinder bore (inner dead center position) or project furthest out of a cylinder bore (outer dead center position). In the present case, the outer dead center position is in changeover region 41, and the inner dead center position is in changeover region 42.

In FIG. 1, two displacement pistons 32 are depicted in the section plane. For the sake of simplicity, the illustration is chosen so that it is not possible for two displacement pistons simultaneously to be in the section plane, even if there is an uneven number of displacement pistons and the angular interval between the displacement pistons is the same.

The component shaft 36 of the drive shaft 14 is rotatably mounted in the central housing part 11 and, in a manner not shown specifically, in the base of the first pot-shaped housing part 25 by means of rolling bearings.

Driving mechanism 10 comprises a cylinder barrel 50, which is of identical design to the cylinder barrel 30 of the first driving mechanism 9 and in which cylinder bores which extend at a slight slope to the axis of rotation 15 and are open on that side of the cylinder barrel which faces away from the central housing part 11, are uniformly distributed and lie on the same pitch circle. A displacement piston 52 is guided in a longitudinally movable manner in each cylinder bore. In housing part 26, a swash plate 53 of identical design to swash plate 33 is mounted so as to be pivotable about a pivoting axis 54 perpendicularly intersecting the axis of rotation 15 and parallel to pivoting axis 34. In operation, the displacement pistons 52 are supported on the swash plate 53 via piston shoes 55 held on the pistons. Cylinder barrel 50 is coupled to a component shaft 56, passing through it, of the drive shaft 14 in a manner secure against relative rotation but allowing axial movement, and in operation is rotated about the axis of rotation 15 in synchronism with cylinder barrel 30 by means of the drive shaft 14.

The component shaft 56 of the drive shaft 14 is rotatably mounted in the central housing part 11 and, in a manner not shown specifically, in the base of the second pot-shaped housing part 26 by means of rolling bearings. Within the central housing part 11, the two component shafts 36 and 56 are coupled to one another for conjoint rotation via a coupling sleeve 43.

In the axial direction, the cylinder barrel 50 is supported on a control plate 57, which, just like control plate 37, is formed with a high-pressure control slot 39, with a low-pressure control slot 38 and with two changeover regions 41 and 42 and is arranged as a mirror image of control plate 37.

The two cylinder barrels 30 and 50 are arranged offset relative to one another by half a piston pitch in the direction of rotation. In the case of five cylinder bores, for example, the piston pitch is 72 degrees. In corresponding fashion, the offset between the two cylinder barrels would be 36 degrees. In the case of six cylinder bores, for example, the piston pitch is 60 degrees. In corresponding fashion, the offset between the two cylinder barrels would be 30 degrees. In the case of nine cylinder bores, for example, the piston pitch is 40 degrees. In corresponding fashion, the offset between the two cylinder barrels would be 20 degrees.

Otherwise, driving mechanism 10 operates in exactly the same way as driving mechanism 9, and therefore reference can be made to the corresponding description in respect of driving mechanism 9.

In order, during the changeover from the low-pressure control slot 38 to the high-pressure control slot 39, to keep pressure peaks in the cylinder bores 31, nonuniform flow and pressure pulsations in the high-pressure control slot 39 and hence in the high-pressure connection 12 of the axial piston pump and in the entire hydraulic system within which the axial piston pump is used to a low level, a fluid volume 65 of defined size is provided, which is designed as a cavity in the central housing part 11 and from which a bore 66 passing through the central housing part 11 and control plate 37 and having an outlet 67 in changeover region 41 starts. After a dead center position of the displacement pistons 32, the outlet 67 is closer to the high-pressure control slot 39 than to the low-pressure control slot 38. The bore 66 has a certain restricting effect or a restrictor is arranged therein. Starting from fluid volume 65 there is a further bore 68, which passes through the central housing part 11 and control plate 57 and has an outlet 69 in changeover region 41 of control plate 57. After a dead center position of the displacement pistons 52, the outlet 69 is likewise closer to the high-pressure control slot 39 than to the low-pressure control slot 38 of control plate 57. Bore 68 also has a certain restricting effect or is provided with a restrictor.

Figure 2:
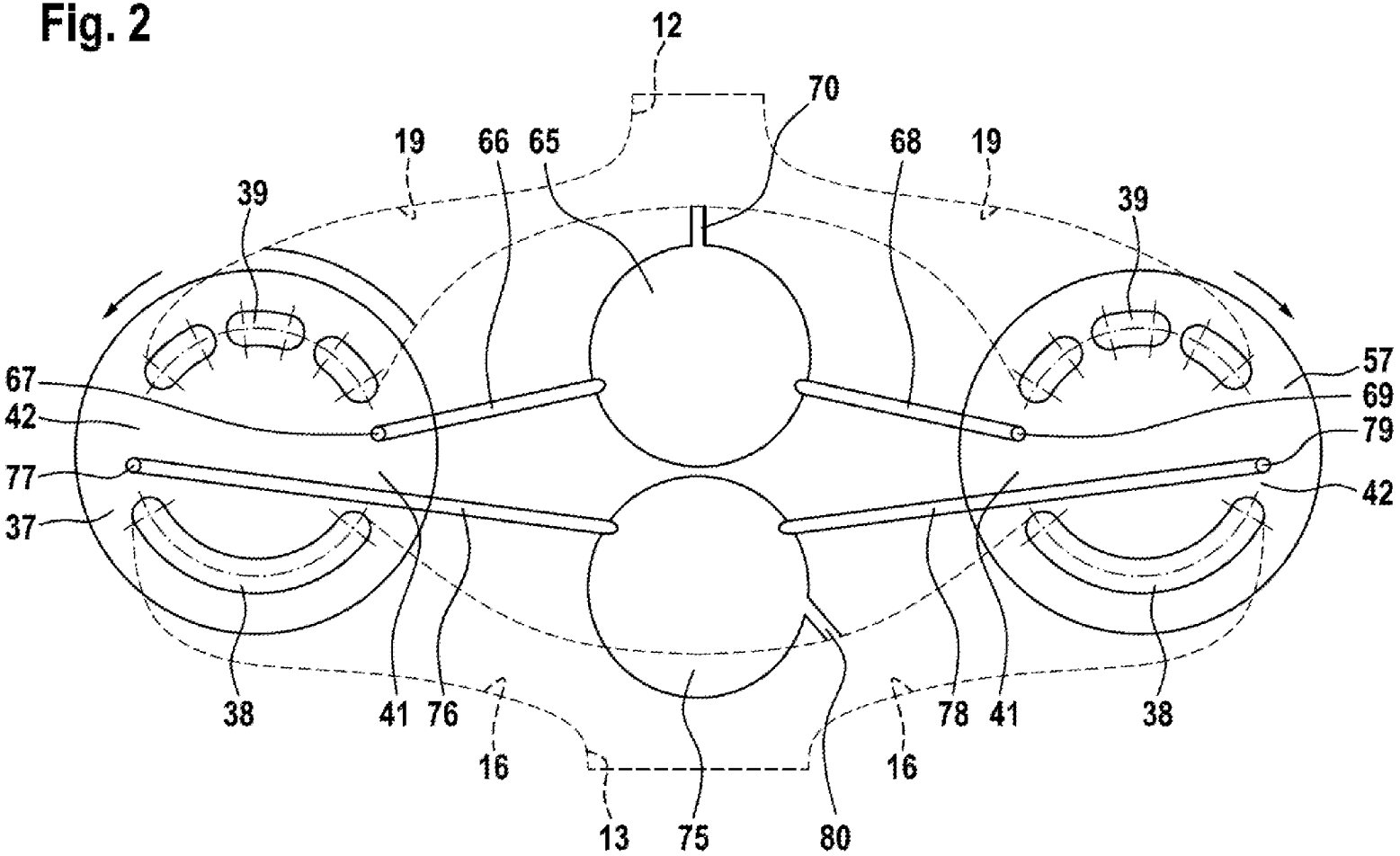
FIG. 2 shows a schematic illustration with a plan view of the control ports of both component pumps and the connection of two precompression volumes.

As an option, fluid volume 65 can additionally also be connected permanently directly to the high-pressure side of the pump. This is indicated in FIG. 2 by a bore 70, in which a restrictor is arranged or which acts as a restrictor.

During the operation of the pump, the connecting openings 40 in the cylinder barrels 30 and 50 move over the control slots 38 and 39 and the changeover regions 41 and 42. Initially, a connecting opening 40—say connecting opening 40 of cylinder barrel 30—is still open to the low-pressure control slot 38. The tank pressure prevails in the corresponding cylinder bore 31. There is high pressure in fluid volume 65.

As a cylinder barrel 30 is rotated further, the connecting opening 40 leaves the low-pressure control slot 38 of control plate 37 and comes into overlap with the outlet 67 of bore 66, initially with a connection to the low-pressure control slot 38 that is at most still greatly restricted, with the result that a fluidic connection is established between cylinder bore 31 and fluid volume 65. Pressure fluid then flows from fluid volume 65 into cylinder bore 31, with the result that the pressure therein rises and the pressure in fluid volume 65 falls. The inflow of pressure fluid into cylinder bore 31 ends when the pressure prevailing in said bore is the same as that prevailing in fluid volume 65. The pressure medium in cylinder bore 31 is now precompressed, and therefore a fluid volume of the same type as fluid volume 65 is also referred to as a precompression volume.

As cylinder barrel 30 is rotated further, the connecting opening 40 reaches the high-pressure control slot 39 and increasingly covers the latter. As a result, a fluidic connection is created not only between the high-pressure control slot 39 and cylinder bore 31 but also between the high-pressure control slot 39 and fluid volume 65, with the result that pressure fluid then flows out of the high-pressure control slot 39 into cylinder bore 31 and into fluid volume 65. When the connecting opening 40 comes out of overlap with the outlet 67 of bore 66, there is once again high pressure in fluid volume 65.

A connecting opening 40 in cylinder barrel 50 then leaves the low-pressure control slot 38 of control plate 57 and, with a connection to the low-pressure control slot 38 that is initially at most still greatly restricted, comes into overlap with the outlet 69 of bore 68, with the result that a fluidic connection is established between the corresponding cylinder bore 31 and fluid volume 65. Pressure fluid then flows from fluid volume 65 into the cylinder bore 31 of cylinder barrel 50, with the result that the pressure in the cylinder bore rises and the pressure in fluid volume 65 falls. The inflow of pressure fluid into cylinder bore 31 ends when the pressure prevailing in said bore is the same as that prevailing in fluid volume 65. The pressure medium in cylinder bore 31 is then precompressed.

As cylinder barrel 50 is rotated further, the connecting opening 40 reaches the high-pressure control slot 39 and increasingly covers the latter. As a result, a fluidic connection is created not only between the high-pressure control slot 39 and cylinder bore 31 but also between the high-pressure control slot 39 and fluid volume 65, with the result that pressure fluid then flows out of the high-pressure control slot 39 into the cylinder bore and into fluid volume 65. When the connecting opening 40 comes out of overlap with the outlet 69 of bore 68, there is once again high pressure in fluid volume 65.

For the two driving mechanisms, therefore, just one precompression volume is provided, and this is effective during the transition of a cylinder bore from the low-pressure control slot to the high-pressure control slot of a control plate.

In addition, a fluid volume of defined size is provided for the changeover of a cylinder bore 31 from the high-pressure control slot 39 to the low-pressure control slot 38. This fluid volume 75 is likewise designed as a cavity in the central housing part 11. Starting from fluid volume 75 there is a bore 76 passing through the central housing part 11 and control plate 37 and having an outlet 77 in changeover region 42. After a dead center position of the displacement pistons 32, the outlet 77 is closer to the low-pressure control slot 38 than to the high-pressure control slot 39. The bore 76 has a certain restricting effect or a restrictor is arranged therein. Starting from fluid volume 75 there is a further bore 78, which passes through the central housing part 11 and control plate 57 and has an outlet 79 in changeover region 42 of control plate 57. After a dead center position of the displacement pistons 52, the outlet 79 is likewise closer to the low-pressure control slot 38 than to the high-pressure control slot 39 of control plate 57. Bore 78 also has a certain restricting effect or is provided with a restrictor.

As an option, fluid volume 75 can additionally also be connected directly to the low-pressure side of the pump. This is indicated in FIG. 2 by a bore 80, in which a restrictor is arranged or which acts as a restrictor.

When a connecting opening 40, after leaving the high-pressure slot 39 of a control plate 37 or 57, comes into overlap with the outlet 77 or 79, pressure medium flows out of the corresponding cylinder bore 31 into fluid volume 75. The pressure in the cylinder bore falls and the pressure in fluid volume 75 rises until the pressures are equal. The cylinder bore is then partially decompressed. When the connecting opening is then simultaneously in overlap with the low-pressure control slot 38 and an outlet 77 or 79, the pressure in the cylinder bore and in fluid volume 75 falls to the low pressure. Although fluid volume 75 thus brings about a partial decompression of the cylinder bore, a fluid volume of this kind is also referred to somewhat inaccurately as a precompression volume (PCV).

LIST OF REFERENCE SIGNS

8 housing
9 first driving mechanism
10 second driving mechanism
11 central housing part
12 high-pressure connection
13 low-pressure connection
14 drive shaft
15 axis of rotation of 14
16 low-pressure passages
17 end wall of 11
18 end wall of 11
19 high-pressure passages
25 first pot-shaped housing part
26 second pot-shaped housing part
30 cylinder barrel
31 cylinder
32 displacement pistons
33 swash plate
34 pivoting axis of 33
35 piston shoe
36 component shaft of 14
37 control plate
38 control slot in 37 and 57
39 control slot in 37 and 57
40 connecting opening
41 changeover region
42 changeover region
43 coupling sleeve
50 cylinder barrel
52 displacement pistons
53 swash plate
54 pivoting axis of 53
55 piston shoe
56 component shaft
57 control plate
65 fluid volume
66 bore
67 outlet of 66
68 bore
69 outlet of 68
70 bore
75 fluid volume
76 bore
77 outlet of 76
78 bore
79 outlet of 78
80 bore

The invention claimed is:

1. A hydrostatic piston machine unit comprising:

a first driving mechanism including first displacement pistons that are arranged in a first rotating cylinder part that defines a plurality of first cylinder spaces, each first cylinder space is configured to be alternately connected via a first respective connecting opening to a first low-pressure control port and a first high-pressure control port of a first stationary control part, on which two first changeover regions are arranged between the first low-pressure control port and the first high-pressure control port, the first displacement pistons configured to reverse direction of motion within the two first changeover regions at respective first dead center positions;

a second driving mechanism including second displacement pistons that are arranged in a second rotating cylinder part that defines a plurality of second cylinder spaces, each second cylinder space configured to be alternately connected via a second respective connecting opening to a second low-pressure control port and a second high-pressure control port of a second stationary control part, on which two second changeover regions are arranged between the second low-pressure control port and the second high-pressure control port, the second displacement pistons configured to reverse direction of motion within the two second changeover regions, each of the first and second displacement pistons performing a reciprocating motion in operation so as to deliver fluid into a common pressure line or a common pressure connection via the respective first or second high-pressure control port;

at least one cavity defining at least one precompression volume that is jointly assigned to both the first and second driving mechanisms;

a first connecting line arranged in one of the two first changeover regions so as to connect the first cylinder spaces to a first cavity of the at least one cavity; and a second connecting line arranged in one of the two second changeover regions so as to connect the second cylinder spaces to the first cavity, wherein the first cavity is connected permanently in a restricted manner to the common pressure connection via a third connecting line.

2. The hydrostatic piston machine unit according to claim 1, wherein:

the at least one cavity includes the first cavity and a second cavity;

one of the first and second cavities defines a first precompression volume of the at least one precompression volume provided for changeover from the first and second low-pressure control ports to the first and second high-pressure control ports; and the other of the first and second cavities defines a second precompression volume of the at least one precompression volume provided for changeover from the first and second high-pressure control ports to the first and second low-pressure control ports.

3. The hydrostatic piston machine unit according to claim 1, wherein:

each of the first respective connecting openings is configured to be connected in the one of the first changeover regions to the at least one cavity via a first outlet, which is arranged in the one of the first changeover regions, of the first connecting line, at the earliest when a connection to one of the first high-pressure control port and the first low-pressure control port is still restricted and before there is an overlap with the other of the first high-pressure control port and the first low-pressure control port; and each of the second respective connecting openings is configured to be connected in the one of the second changeover regions to the at least one cavity via a second outlet, which is arranged in the one of the second changeover regions, of the second connecting line, at the earliest when a connection to one of the second high-pressure control port and the second low-pressure control port is still restricted and before there is an overlap with the other of the second high-pressure control port and the second low-pressure control port.

4. The hydrostatic piston machine unit according to claim 3, wherein:

within a first angular range, one of the first respective connecting openings is open simultaneously to the first cavity and to a first respective control port of the first high-pressure and low-pressure control ports to which a changeover is being made, and to match a pressure in the first cavity to a pressure in the first respective control port, pressure fluid flows between the first respective control port and the first cavity via the one of the first respective connecting openings and via the first connecting line; and within a second angular range, one of the second respective connecting openings is open simultaneously to the first cavity and to a second respective control port of the first high-pressure and low-pressure control ports to which a changeover is being made, and to match a pressure in the first cavity to a pressure in the second respective control port, pressure fluid flows between the second respective control port and the first cavity via the one of the second respective connecting openings and via the second connecting line.

5. The hydrostatic piston machine unit according to claim 1, wherein:

the hydrostatic piston machine unit is an axial piston machine unit of swash plate design; and the first rotating cylinder part and the second rotating cylinder part are arranged in axial alignment with one another.

6. The hydrostatic piston machine unit according to claim 5, wherein the first and second rotating cylinder parts are driven via a common shaft.

7. The hydrostatic piston machine unit according to claim 1, wherein the first and second driving mechanisms each have the same number of respective first and second displacement pistons and are rotationally offset relative to one another by a half piston pitch in such a way that each of the first displacement pistons reverses direction of motion in a center of an angular interval between two of the second displacement pistons, and each of the second displacement pistons reverses direction of motion in a center of an angular interval between two of the first displacement pistons.

8. The hydrostatic piston machine unit according to claim 1, wherein:

the first and second driving mechanisms are rotationally offset relative to one another in such a way that each of the first displacement pistons reverses direction of motion in a center of an angular interval between two of the second displacement pistons, and each of the second displacement pistons reverses direction of motion in a center of an angular interval between two of the first displacement pistons; and alternately either only one of the first cylinder spaces or only one of the second cylinder spaces is connected directly to the first cavity.

9. The hydrostatic piston machine unit according to claim 1, further comprising:

a common housing accommodating the first and second driving mechanisms, the common housing defining the at least one cavity;

a further pressure connection, which is common to the first and second driving mechanisms; and the pressure connection and the further pressure connection are formed on the common housing.

10. The hydrostatic piston machine unit according to claim 1, wherein the hydrostatic piston machine unit is a hydrostatic axial piston machine unit.

11. The hydrostatic piston machine unit according to claim 1, wherein the first cavity has a greater cross-sectional area than the first and second connecting lines.

12. A hydrostatic piston machine unit comprising:

a first driving mechanism including first displacement pistons that are arranged in a first rotating cylinder part that defines a plurality of first cylinder spaces, each first cylinder space is configured to be alternately connected via a first respective connecting opening to a first low-pressure control port and a first high-pressure control port of a first stationary control part, on which two first changeover regions are arranged between the first low-pressure control port and the first high-pressure control port, the first displacement pistons configured to reverse direction of motion within the two first changeover regions at respective first dead center positions;

a second driving mechanism including second displacement pistons that are arranged in a second rotating cylinder part that defines a plurality of second cylinder spaces, each second cylinder space configured to be alternately connected via a second respective connecting opening to a second low-pressure control port and a second high-pressure control port of a second stationary control part, on which two second changeover regions are arranged between the second low-pressure control port and the second high-pressure control port, the second displacement pistons configured to reverse direction of motion within the two second changeover regions, each of the first and second displacement pistons performing a reciprocating motion in operation so as to deliver fluid into a common pressure line or a common pressure connection via the respective first or second high-pressure control port;

at least one cavity defining at least one precompression volume that is jointly assigned to both the first and second driving mechanisms;

a first connecting line arranged in one of the two first changeover regions so as to connect the first cylinder spaces to a first cavity of the at least one cavity; and a second connecting line arranged in one of the two second changeover regions so as to connect the second cylinder spaces to the first cavity, wherein the first cavity defines a first precompression volume of the at least one precompression volume, and the first precompression volume corresponds to a volume of one of the first and second cylinder spaces.

13. The hydrostatic piston machine unit according to claim 12, wherein the first cavity is connected permanently in a restricted manner to the common pressure connection via a third connecting line.

* * * * *